US005228498A

United States Patent [19]

Harada et al.

[11] Patent Number: 5,228,498

[45] Date of Patent: Jul. 20, 1993

[54] CONTINUOUS CASTING EQUIPMENT AND CONTINUOUS CASTING METHOD

[75] Inventors: Shinichi Harada; Hiroshi Kawaguchi; Atsushi Yamamoto; Masamitsu Nakatani, all of Kobe, Japan

[73] Assignee: Kabushiki Kaisha Kobe Seiko Sho, Kobe, Japan

[21] Appl. No.: 938,685

[22] Filed: Sep. 1, 1992

Related U.S. Application Data

[63] Continuation of Ser. No. 687,672, Apr. 19, 1991, abandoned.

[30] Foreign Application Priority Data

May 31, 1990 [JP] Japan ..... 2-58261[U]
Jul. 24, 1990 [JP] Japan ..... 2-78252[U]

[51] Int. Cl.[5] ..... B22D 47/00; B22D 11/10

[52] U.S. Cl. ..... 164/488; 164/437; 164/438; 266/276

[58] Field of Search ..... 164/459, 488, 133, 136, 164/418, 437, 438, 335, 336; 222/590, 591, 593, 604; 266/276, 275, 165, 143

[56] References Cited

U.S. PATENT DOCUMENTS 3,790,444 7/1976 Brotzmann et al. ..... 222/590
4,124,152 11/1978 Fioravazzi ..... 222/604
4,799,535 1/1989 Lemper .

FOREIGN PATENT DOCUMENTS 0155551 6/1990 Japan ..... 164/418

*Primary Examiner*—Richard K. Seidel
*Assistant Examiner*—Erik R. Puknys
*Attorney, Agent, or Firm*—Oblon, Spivak, McClelland, Maier & Neustadt

[57] ABSTRACT

A continuous casting equipment which can be applied to a wide variation of casting capacity for continuous casting and by which a continuous casting operation can be performed with safety. The continuous casting equipment comprises a tundish for receiving molten metal poured from a ladle and for pouring the molten metal into a mold, a travelling truck for carrying the tundish between a molding section at which the mold is located and a skimming section at which molten scum in the tundish is to be discharged, and a tilting apparatus located at the skimming section for tilting the tundish together with the travelling truck on which the tundish is carried to allow molten scum to be discharged from within the tundish. Also an improved continuous casting method is disclosed.

24 Claims, 15 Drawing Sheets

CONTINUOUS CASTING EQUIPMENT AND CONTINUOUS CASTING METHOD

This application is a continuation of application Ser. No. 07/687,672, filed on Apr. 19, 1991, now abandoned.

BACKGROUND OF THE INVENTION

1. Field of the Invention

This invention relates to a continuous casting equipment for continuously casting molten metal supplied from a converter or the like.

2. Description of the Related Art

A continuous casting equipment is disclosed in (refer to Japanese Patent Laid-Open Application No. 63-220951 (Japanese Patent Application No. 62-51125)) and is shown in FIGS. 10*a* to 10*e*. Referring to FIGS. 10*a* to 10*e*, the continuous casting equipment shown includes a ladle exchanging apparatus 201 provided uprightly on an upper face of a side portion of a platform 217. The ladle exchanging apparatus 201 includes at least two arms 201*a* provided for pivotal motion independent of each other such that a ladle 203 is removably held thereon similarly as in a conventionally known ladle exchanging apparatus. A travel passageway 211 is provided in parallel to the ladle exchanging apparatus 201 on the other side portion of the upper face of the platform 217. The travel passageway 211 includes a pair of parallel rails 211*a* and a base 211*b* on which the rails 211*a* are supported. A travelling truck 202 has a plurality of travelling wheels 218 on a bottom face thereof and has a pair of guide wheels 219 on the opposite sides thereof. The guide wheels 219 are guided by the rails 211*a* such that the travelling truck 202 is moved back and forth linearly along the travel passageway 211 between a mold 208 and a skimming section 210 provided on the platform 217. The mold 208 is similar to that which is employed conventionally in a continuous casting equipment while the skimming section 210 is a recessed spacing formed to extend upwardly and downwardly through the platform 217 and includes a skimmed substance accommodating pot 215.

As shown in FIGS. 10*c* and 10*d*, a skimming window hole 214 is formed to extend through a substantially central portion of the travelling truck 202 and a cover 214*a* is provided for opening and closing movement on the skimming window hole 214. A turning frame 202*b* is provided for horizontal turning movement at a front portion of the truck 202. A tiltable frame 202*a* having a substantially chute-shaped section is mounted for tilting movement in upward and downward directions around a pair of supporting shafts 212 on an upper face of the turning frame 202*b* such that it extends from a front end of the truck 202. For such pivotal motion, a pair of tilting cylinders 220 are supported for pivotal motion on the turning frame 202*b* and each has a piston rod 220*a* connected to the tiltable frame 202*a*, and the tundish 204 is supported exchangeably in the tiltable frame 202*a* by way of a pin shaft 221.

A frame 222 is installed at a front end of the tiltable frame 202*a*, and a heating apparatus 202*c* is mounted for adjustment in position on the frame 222. For example, a known plasma heating apparatus or induction heating apparatus can be suitably employed as the heating apparatus 202*c*. A molten metal pouring valve opening 205 is provided at a front end side of a bottom portion of the tundish 204, and a slide valve or the like is employed as a valve for the valve opening 205 and a molten metal pouring nozzle 209 is removably provided for the valve opening 205. Meanwhile, a skimming valve opening 206 similarly employing a slide valve or the like is provided at a bottom portion of the ladle 203 and a skimming nozzle 207 is removaly fitted in the skimming valve opening 206. In this instance, the skimming valve opening 206 of the ladle 203 is set at a position just opposing to the position of an axis of turning motion of the tundish 204 (position of the center of turning motion of the turning frame 202*b*) when the ladle 203 is turned on the tundish 204 by way of one of the arms 201*a* as shown in FIGS. 10*a* and 10*b*. Consequently, the skimming location of the ladle 203 is fixed and invariable over all of the steps of a turning procedure when the tundish 204 is turned from its standby position (b) to its casting position (a) and the molten metal receiving location of the tundish 204 is fixed. Accordingly, turning movement of the tundish 204 while receiving molten metal is facilitated. Meanwhile, a skim gate 213 for discharging substances to be skimmed such as ground metal or scum is opened on a side wall face of the tundish 204 remote from the molten metal pouring valve opening 205 as shown in FIG. 10*e*.

The continuous casting equipment having such construction as described above is used in the following manner in continuous casting. The arms 201*a* of the ladle exchanging apparatus 201 are retracted away from the travel passageway 211, and the tundish 204 on the travelling truck 202 stopped at a position not shown is turned to the standby position (b) perpendicular to the travel passageway 211 as indicated by an alternate two long and short dashes line by way of the turning frame 202*b*. Then, maintenance or repair of the molten metal pouring valve opening 205 and/or skim gate 213 is performed, and maintenance of the heating apparatus 202*c*, a casting preparing operation such as heating of the tundish 204 by the heating apparatus 202*c* and so forth are performed. Simultaneously, the ladle 203 filled with molten metal is loaded onto one of the empty arms 201*a* of the ladle exchanging device 201 and is then turned by way of the arms 201*a* to a position above the tundish 204 for which such preparing operation has been completed. Then, the skimming nozzle 207 is set in position between the tundish 204 and the skimming valve opening 206 of the ladle 203 and is then sealed, and then the valve of the skimming valve opening 206 is opened so that molten metal in the ladle 203 is poured into the tundish 204. After a predetermined amount of molten metal is accumulated in the tundish 204, heating of the molten metal by the heating apparatus 202*c* is started while minimizing the opening of the valve of the skimming valve opening 206. Then, the tundish 204 is turned to its casting position (a) while receiving molten substance at a minimum flow rate from the ladle 203 and while being continuosly heated by the heating apparatus 202*c*. After the tuning movement of the tundish 204 to the casting position (a) is completed, the molten metal pouring nozzle 209 is set in position between the molten metal valve opening 205 of the tundish 204 and the mold 208 and is then sealed, and then the valve of the molten metal pouring valve opening 205 of the tundish 204 is opened to start continuous casting. During such continuous casting, upon continuous casting, when casting of all of the molten metal in the ladle 203 is completed, the skimming nozzle 207 thereof is moved away from the position and the empty ladle 203 is turned to its retracted position while another ladle 203, filled with molten substance and already loaded on the other arm 201*a*, is turned to its casting position, at which the molten metal is skimmed into the tundish 204 by way of a connection of the skimming nozzle 207. Consequently, casting can be continued successively.

Upon completion of such casting, the valve of the skimming valve opening 206 of the ladle 203 is closed and a remaining amount of molten metal in the tundish 204 is monitored, and the valve of the molten metal pouring valve opening 205 of the tundish 204 is closed after completion of such casting, thereby completing the casting operation. Subsequently, the ladle 203 is turned to move away from the position above the tundish 204, and ground metal, scum and so forth remaining in the tundish 204 are heated into a molten condition by the heating apparatus 202*c*. The travelling truck 202 is moved to its skimming position (c) as shown in FIG. 10*e*, and the molten substance to be skimmed is discharged from the skim gate 213 of the tundish 204 by tilting the tiltable frame 202*a* around the supporting shafts 212 and opening the skimming window hole 214 of the truck 202 so that it is accommodated into the accommodating pot 215 of the skimming section 210. After such skimming is completed, the tiltable frame 202 is returned to move the tundish 204 to its horizontal position, and then the travelling truck 202 is moved again to and stopped at the casting position (a) to perform a next casting preparing operation. Meanwhile, in order to exchange the tundish 204 itself, a clamp 216 for the tiltable frame 202*a* on which the tundish 204 is directly supported is released as illustrated in FIG. 10*c*, and the tundish 204 is carried out by means of a crane or the like to exchange the tundish 204.

With the continuous casting equipment described above, continuous casting and continuous continuous casting as well as continuous casting of different types of steel and so forth can be performed efficiently with simple and compact construction including the single ladle exchanging apparatus 210 formed from a ladle turret or the like which is conventionally employed, the single tundish travelling truck 202 and the single tundish 204 provided for turning movement and also for tilting movement on the truck 202 and having the heating apparatus 202*c* thereon. However, the continuous casting equipment has such problems as described below.

(1) Since the horizontally turnable turning frame 202*b* having a turning mechanism provided thereon is carried at a front portion of the travelling truck 202 and the tiltable frame 202*a* having a substantially chute-shaped section and having a tilting mechanism provided thereon is provided on the upper face of the frame 202*b*, the travelling truck 202 has a generally great overall height. Besides, since the tundish 204 must be mounted on the tiltable frame 202*b* provided in such a manner as to be projected from the front end of the truck 202 such that it extends above the mold 208 and besides the tundish 204 must be turned in such condition, the travelling truck 202 is liable to fall down and besides a high load is applied to the front wheels of the truck 202. Further, while the conventional equipment is constituted such that, in order to prevent such possible falling down of the travelling truck 202, the guide wheels 219 are provided on the opposite sides of the travelling truck 202 and are guided by the rails 211*a* provided on the base 211*b* having an inverted L-shaped section, and in order to allow the travelling truck 202 to bear a high load, the front wheels have a great diameter and/or a great width; such construction naturally has a limitation, and particularly in the case wherein the tundish 204 has a great capacity for the continuous casting for a cast article of a great sectional area, the travelling truck 202 is excessively great in overall size. Further, no such travelling wheel 218 can bear such load, and also construction for the prevention of falling down of the travelling truck 202 is great in size, and besides the safety in casting operation is susceptible. Consequently, the continuous casting equipment is not in practical use.

(2) On the other hand, while ground metal, scum and so forth which remain in the tundish 204 after completion of casting are discharged from the skim gate 213 of the tundish 204 and accommodated in the accommodating pot 215 of the skimming section 210 by moving the travelling truck 202 to its skimming position (c), tilting the tiltable frame 202*a* around the supporting shafts 212 and opening the skimming window hole 214 of the truck 202, since the tiltable frame 202*a* can be tilted, particularly in the case of the tundish 204 of a large capacity for the continuous casting for a cast piece of a great sectional area, by only 45 degrees at the greatest taking the safety into consideration because the piston rods 220*a* of the tilting cylinders 220 supported for pivotal motion on the turning frame 202*b* are connected to the tilting frame 202*a* and the tundish 204 is only secured in the tilting frame 202*a* by means of the pin shaft 221, ground metal, scum and so forth in the tundish 204 cannot flow out completely. Further, since the distance from the skim gate 213 to the accommodating pot 215 is great, ground metal, scum and so forth are likely scattered.

SUMMARY OF THE INVENTION

It is an object of the present invention to provide a continuous casting equipment and a continuous casting method which can be applied to a wide variation of casting capacity for continuous casting and by which a continuous casting operation can be performed with safety.

In order to attain the object, according to an aspect of the present invention, there is provided a continuous casting equipment which comprises a tundish for receiving molten metal poured from a ladle and for pouring the molten metal into a mold, a travelling truck for carrying the tundish between a molding section at which the mold is located and a skimming section at which molten scum in the tundish is to be discharged, and a tilting apparatus located at the skimming section for tilting the tundish together with the travelling truck on which the tundish is carried to allow molten scum to be discharged from within the tundish.

Preferably, the continuous casting equipment further comprises arresting means for arresting the travelling truck on the tilting apparatus when the travelling truck is tilted by the tilting apparatus, the arresting means including a pair of arresting elements provided on the opposite sides of the travel rail for engaging with the travelling truck and an uprightly erected frame erected uprightly at a rear end portion of the tiltable table. The tilting apparatus may include a tiltable table for receiving the travelling truck thereon, the tiltable table having part of the travel rail provided on an upper face thereof, and a tilting mechanism for tilting the tiltable table. The continuous casting equipment may further comprise a pivoting apparatus provided at the molding section for pivoting the tundish around a vertical axis together with the traveling truck on which the tundish is carried, and the pivoting apparatus may include a pivotal table having part of the travel rail provided on an upper face thereof for receiving the travelling truck thereon, and a pivoting mechanism for pivoting the pivotal table around a vertical axis.

With the continuous casting equipment, the tundish is not pivoted nor tilted on the travelling truck, and the height to the tundish on the travelling truck can be made low. Further, since the position of the center of gravity of the tundish presents little variation on the travelling truck, the tundish can be placed with certainty on the travelling truck such that the load may be applied uniformly on wheels of the travelling truck. Moreover it is unnecessary to take care of possible falling down of the travelling truck. Further, since the tundish can be placed on the pivotal table of the pivoting apparatus in a condition wherein it is placed stably on the travelling truck and the tundish can be pivoted to its standby position, casting position or any other position, maintenance of the tundish at the standby position and a casting preparing operation, a casting operation and so forth of the tundish at the casting position can be performed with safety. Besides, since the tundish can be loaded onto the tiltable table of the tilting apparatus in the same condition and can be tilted while sufficiently preventing falling down of the travelling truck by the arresting means on the tiltable table, the tundish can be tilted vertically with safety, and consequently, ground metal, scum and so forth of the tundish can be discharged completely. Further, since the distance from a skim gate to a skimmed substance accommodating vessel can be reduced, ground metal, scum and so forth can be skimmed while minimizing possible dispersion thereof.

According to another aspect of the present invention, there is provided a continuous casting method which comprises the steps of moving, after completion of a preceding casting operation, a travelling truck on which a tundish is carried from a molding section at which a mold is located to a skimming section at which molten scum in said tundish is to be discharged, tilting, at said skimming section, said tundish together with said travelling truck on which said tundish is carried to allow molten scum to be discharged from within said tundish, returning said travelling truck to its horizontal position, moving said travelling truck on which said tundish is carried from said skimming section at which molten scum in said tundish is to be discharged to said molding section at which said mold is located, and performing a next casting operation.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENT

Figure 1:
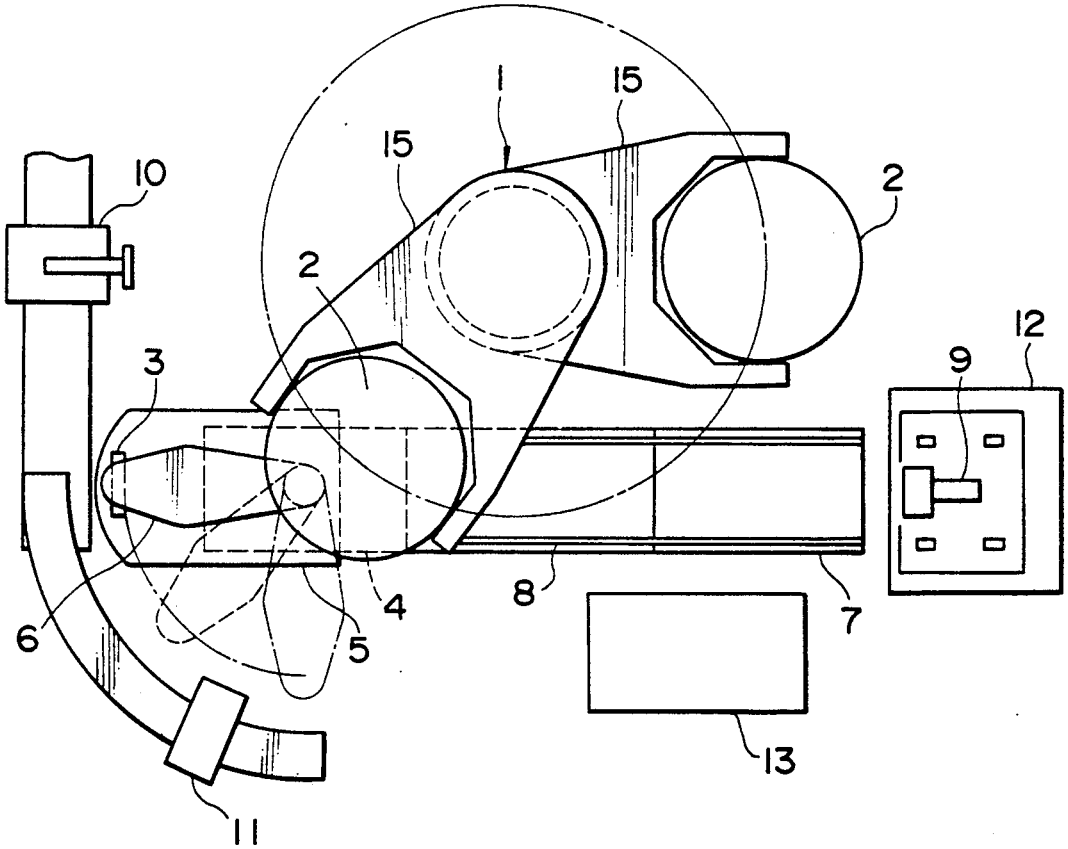
FIG. 1 is a plan view showing a general arrangement of a continuous casting equipment according to the present invention.

Referring first to FIG. 1, there is shown a general arrangement of a continuous casting equipment according to the present invention. The continuous casting equipment shown includes a ladle exchanging apparatus 1 for changing a ladle 2, a mold 3, a pivoting apparatus 4, a travelling truck 5, a tundish 6, a tilting apparatus 7, a pair of travel rails 8 for the travelling truck 5, a heating burner apparatus 9, a handling apparatus 10 for a dipping nozzle, a plasma heating apparatus 11, and a pair of decks 12 and 13 for the maintenance operation of the tundish 6 after skimming. The ladle exchanging apparatus 1, mold 3, pivoting apparatus 4, tilting apparatus 7 and heating burner apparatus 9 are provided on a platform 14 provided on a floor (FL). The ladle exchanging apparatus 1 is erected uprightly on an upper face of the platform 14 and includes at least two arms 15 mounted for turning motion independently of each other. A ladle 2 is removably held on each of the arms 15 as in a conventionally known ladle exchanging apparatus.

Figure 2A:
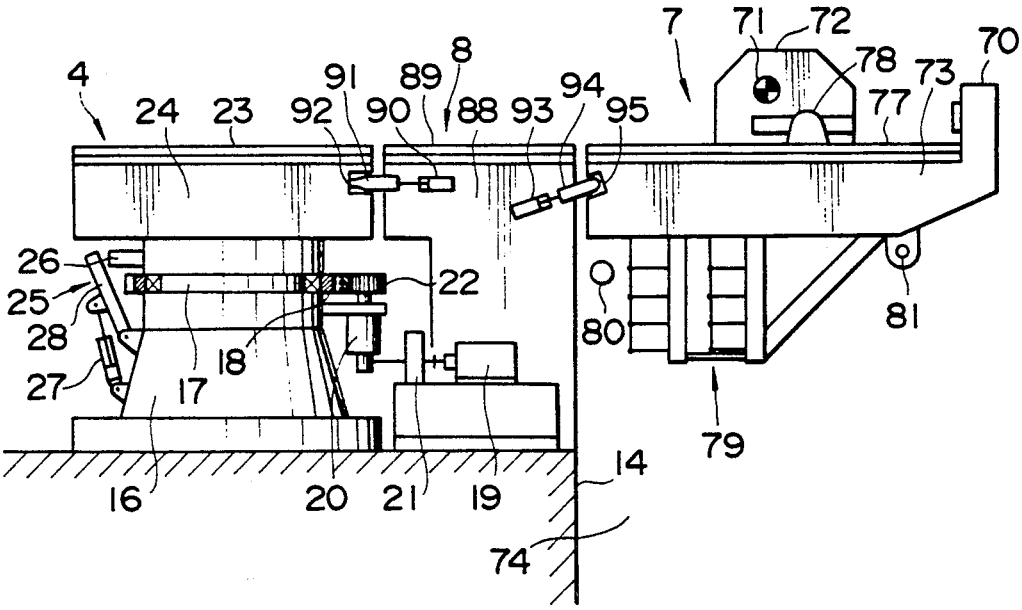
FIGS. 2*a* and 2*b* are a front elevational view and a top plan view, respectively, showing an arrangement of a pivoting apparatus, a tilting apparatus and a travel rail of the continuous casting equipment of FIG. 1.
Figure 2B:
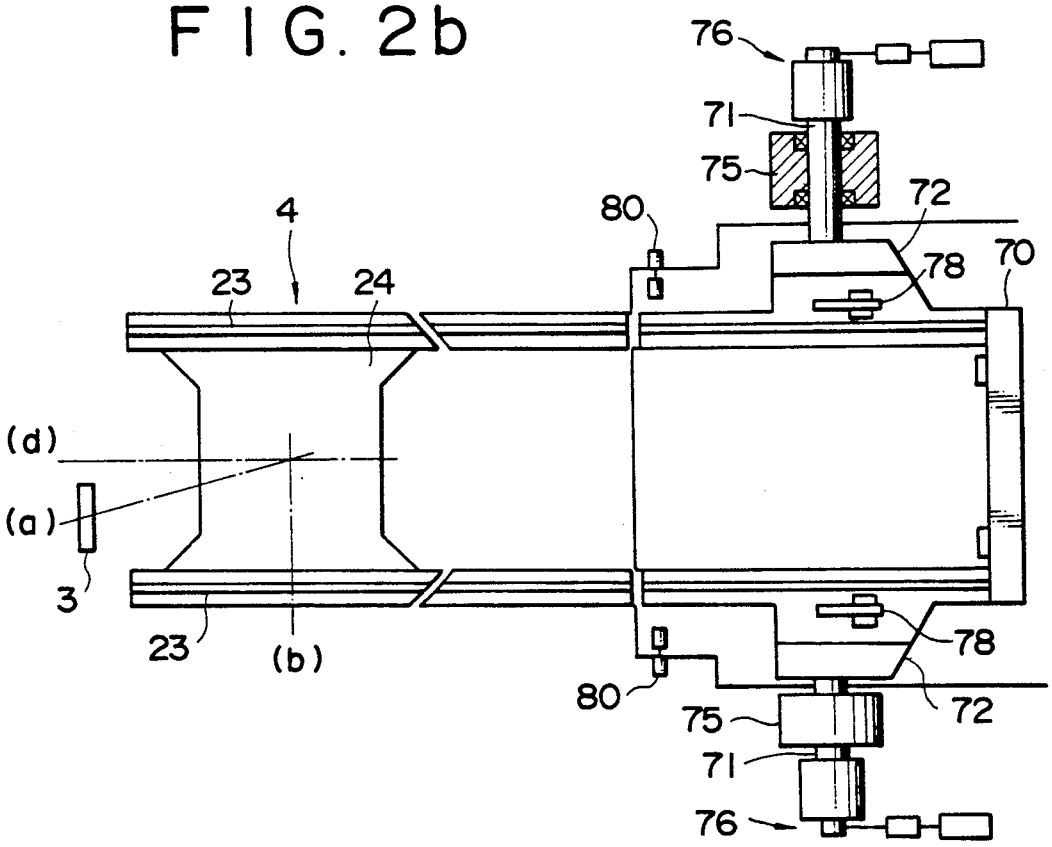

Referring now to FIGS. 2*a* and 2*b*, the pivoting apparatus 4 is erected uprightly at a location sidewardly of the mold 3 and includes a cylindrical base 16, a pivotal shaft 17 provided for pivotal motion on the cylindrical base 16, a gear 18 fitted on and secured to the pivotal shaft 17, a pinion 22 held in meshing engagement with the gear 18 and connected to a drive motor 19 by way of a speed reducer 20 and an electromagnetic brake 21, and a pivotal table 24 secured to an upper portion of the pivotal shaft 17 and having installed on an upper face thereof a pair of rails 23 which make part of the travel rails 8. The pivotal table 24 is pivoted from and to a travelling position (d), a casting position (a) and a standby position (b) by the drive motor 19 and is fixed to each of such positions by a locking mechanism 25. The locking mechanism 25 is constituted from a plurality of pivotal locking wedges 26 securely mounted on an outer periphery of a lower portion of the pivotal table 24 in a corresponding relationship to the individual positions, and a rocking arm 28 mounted for rocking motion on a side wall of the cylindrical base 16 by a cylinder 27. A suitable one of the pivotal locking wedges 26 is removably received in a hole formed at an end portion of the rocking arm 28 to fix the pivotal table 24 at the position.

Figure 2C:
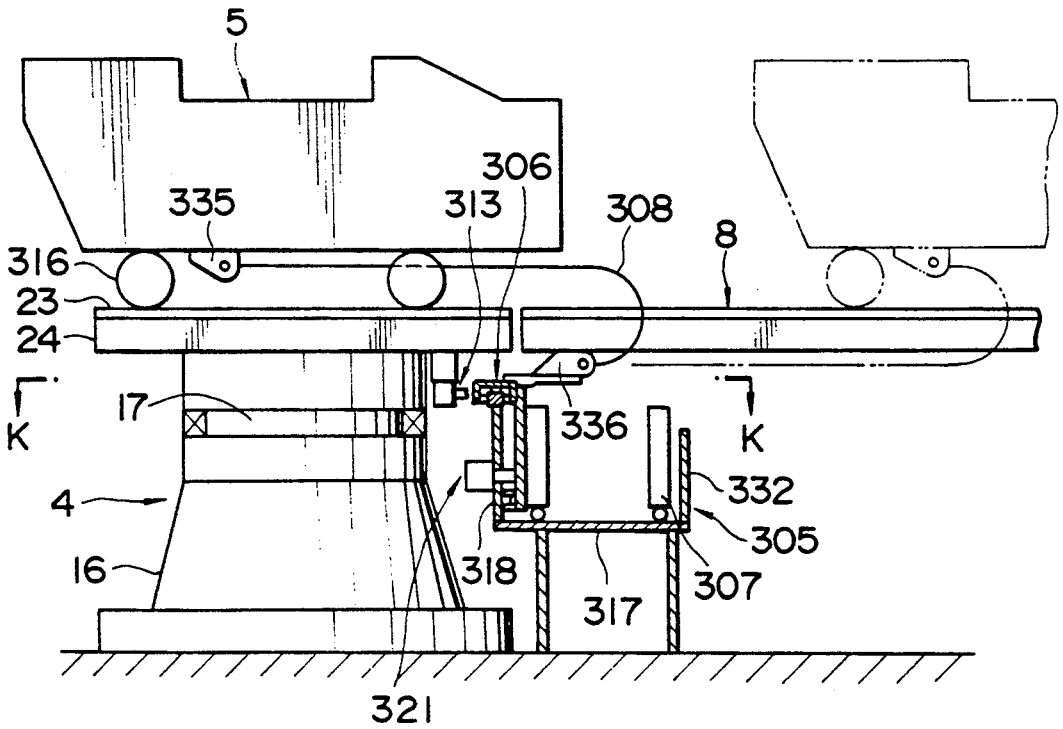
FIG. 2*c* is a front elevational view showing a supporting apparatus for cables to the travelling truck of the continuous casting equipment of FIG. 1.
Figure 2D:
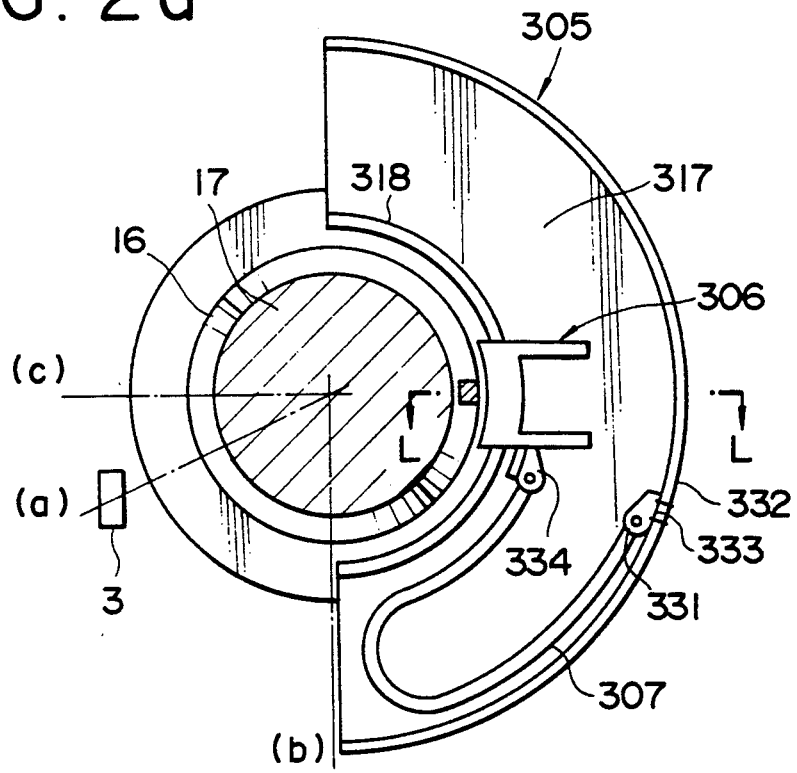
FIG. 2*d* is a sectional view taken along line K—K of FIG. 2*c;*
Figure 2E:
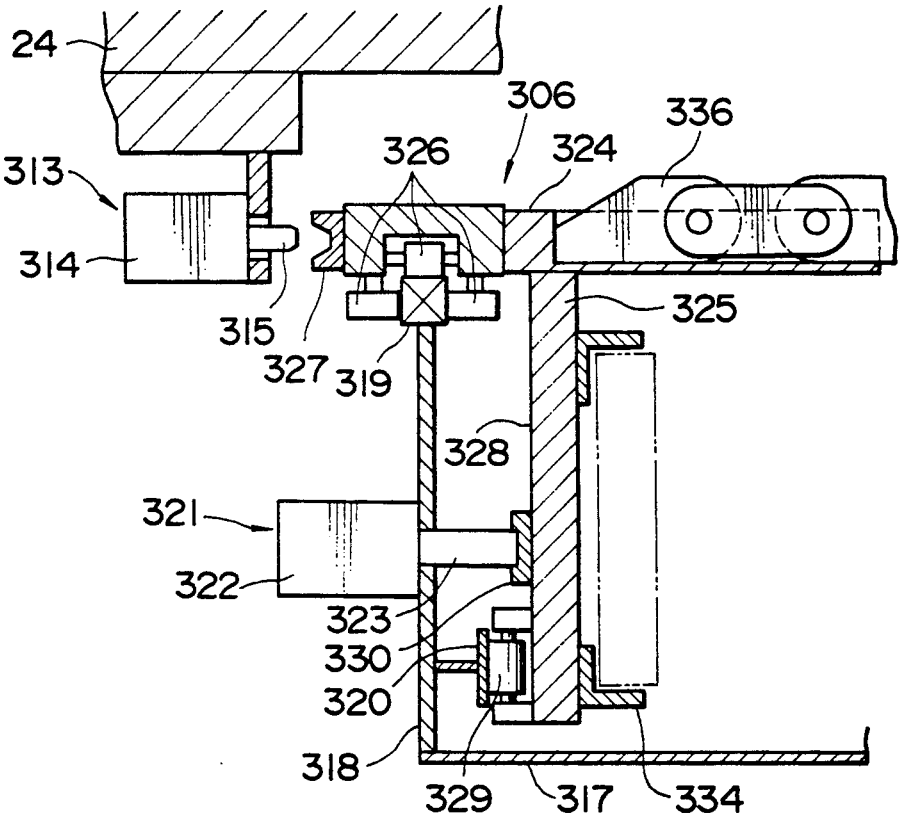
FIG. 2*e* is an enlarged sectional view taken along line L—L of FIG. 2*d;*

Referring now to FIGS. 2*c*, 2*d* and 2*e*, a cylinder 314 constituting an arresting apparatus 313 is located on a lower face of the pivotal table 24 below one of the rails 23 remote from the mold 3 and has a cylinder rod 315 disposed for outwardly advancing and inwardly retracting movement.

The rails 23 making the part of the rails 8 as described hereinabove are provided on the upper face of the pivotal table 24 at a same height as the remaining adjacent portions of the rails 8 which are provided on an upper face of an intermediate frame 88 (refer to FIG. 2*a*). The rails 23 are connected to the remaining portions of the rails 8 when the pivotal table 24 is fixed at its travelling position (d).

The travelling truck 5 can removably receive thereon the molten metal pouring tundish 6 (FIG. 1) and is driven to travel on the rails 8 by a drive motor (not shown) connected to front wheels 316 of the travelling truck 5. When the travelling truck 5 is positioned on the rails 23, the travelling truck 5 is pivoted by pivotal motion of the pivotal table 24 to its travelling position (d), casting position (a) or standby position (b).

A trough 305 has a trough body 317 having a semicircular shape in plan and disposed remote from the mold 3 such that the center of the semicircular profile thereof coincides with the center of pivotal motion of the pivoting apparatus 4. A rail 319 is provided at an upper end of an inner wall 318 of the trough 305 which extends upwardly from an inner circumferential edge of the trough body 317 and presents a semicircular shape in plan while another rail 320 is provided on a radially outer face, that is, an inside face, of the inner wall 318 of the trough 305. A cylinder 322 which constitutes an arresting apparatus 321 is mounted at a circumferentially central location of a radially inner face, that is, an outside face, of the inner wall 318 of the trough 305 such that a cylinder rod thereof 323 may be advanced into and retracted from the inside of the trough body 305.

A further travelling truck or travelling device 306 includes a horizontal member 324 and a vertical member 325 securely mounted on a lower face of the horizontal member 324. Three rollers 326 are mounted on one of portions of a lower face of the horizontal member 324 defined by the vertical member 325 such that they are rolled on a top face and the opposite inner and outer faces of the rail 319 provided at the top end of the inner wall 318 of the trough 305. A receiving member 327 is provided on a radially inner face of the horizontal member 324 such that it may receive therein the cylinder rod 315 of the arresting apparatus 313 provided on the lower face of the pivotal table 24. Further, a roller 329 is provided at a central location of an outer face, that is, a radially inner face, of the inner wall 318 of the trough 325 such that it may be rolled on the rail 320 provided on the inside face of the inner wall 318 of the trough 305. A receiving member 330 is located on the radially inner face of the inner wall 318 of the trough 305 just above the roller 329 such that it may receive therein the cylinder rod 323 of the arresting apparatus 321 provided at the central location of the radially inner face of the inner wall 318 of the trough 305.

A pair of flexible members 307 and 308 are provided. A conventional cable bearer on the market (produced by Kabushiki Kaisha Tsubakimoto Chain) may be employed for each of such flexible members 307 and 308. The flexible member 307 is secured at an end 331 thereof to a cable entrance 333 of an outer wall 332 of the trough 305 which extends upwardly from an outer circumferential edge of the semi-circular trough body 317. The flexible member 307 is secured at the other end 334 thereof to a radially outer face of the vertical member 325 of the travelling truck 306. Then, the flexible member 307 is accommodated in a folded condition in the trough 305 between the inner and outer walls 318 and 332 as seen in FIG. 2*d*. On the other hand, the other flexible member 308 is connected at an end 335 thereof to an outer bottom face of the travelling truck 5 and at the other end 336 thereof to an upper face of the horizontal member 324 of the travelling truck 306. Then, the flexible member 308 is provided in a folded condition between the outer bottom face of the travelling truck 5 and the horizontal member 324 of the moving truck 306 as seen in FIG. 2*c*. Thus, cables (not shown) to the travelling truck 5 are introduced to the outer bottom face of the travelling truck 5 from the cable entrance 333 of the outer wall 332 of the trough 305 through fitting holes (not shown) in the cable bearers 307 and 308.

In the cable supporting apparatus for the travelling truck 5 of the continuous casting equipment having such construction as described above, when the pivotal table 24 is at its travelling position (d) at which the rails 23 of the rails 8 are connected to the remaining portions of the rails 8, the travelling truck 5 is stopped from movement by operation of at least one of the arresting apparatus 313 and 321. Then, when the the pivotal table 24 is pivoted from the travelling position (d) to the casting position (a) and then to the standby position (b) after the travelling truck 5 has been moved to the pivotal table 24, the arresting apparatus 313 is rendered operative while the other arresting apparatus 321 is rendered inoperative, and consequently, the travelling truck 306 is moved along the inner wall 318 of the trough 317 in a synchronized relationship with pivotal motion of the pivotal table 24 while being accompanied by the cable bearer 308. On the other hand, when the travelling truck 5 is to be moved, at the travelling position (d) of the pivotal table 24, from the rails 23 on the pivotal table 24 to the other portions of the travel rails 8, now the arresting apparatus 313 is rendered inoperative and the other arresting apparatus 321 is rendered operative after the pivotal table 24 has been moved to the travelling position (d), and consequently, the cable bearer 308 follows the travelling truck 5 when the travelling truck 5 is moved while the pivotal table 24 can be pivoted because it has been released from the arresting apparatus 313. Accordingly, if the pivotal table 24 is pivoted to any position at which it does not make an obstacle, then some desired operation around the pivotal cable 24 such as, for example, maintenance or repair of the mold 3 can be performed after then.

Thus, with the cable supporting apparatus for the travelling truck of the continuous casting equipment having such construction as described above, the cables can follow complicated motion of the travelling truck and so forth including pivotal motion and travelling motion of the travelling truck and tilting motion for a skimming operation without causing any trouble to various incidental equipments to the continuous casting equipment such as the travelling truck, the pivoting apparatus, the travel rails and the ladle exchanging apparatus.

Figure 3A:
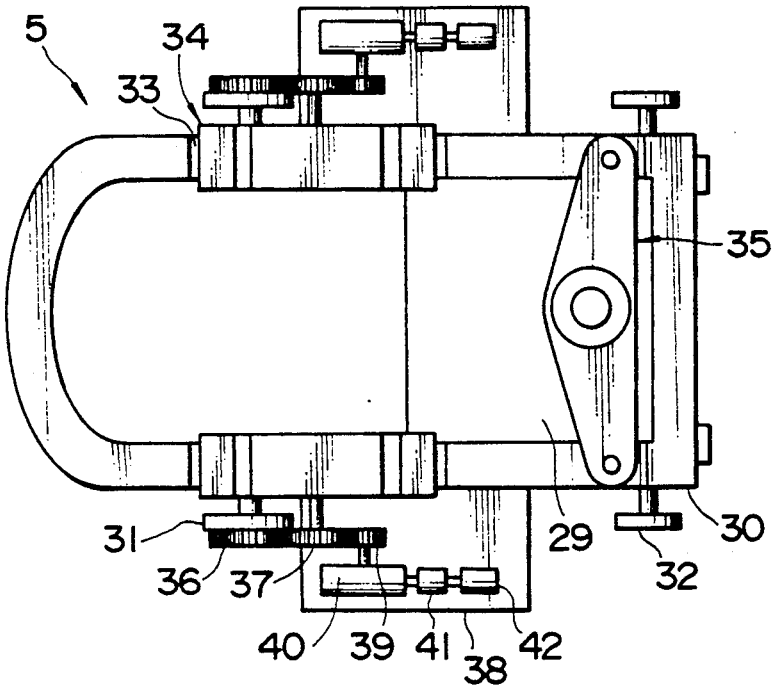
FIGS. 3*a* and 3*b* are a front elevational view and a side elevational view, respectively, of a travelling truck of the continuous casting equipment of FIG. 1.
Figure 3B:
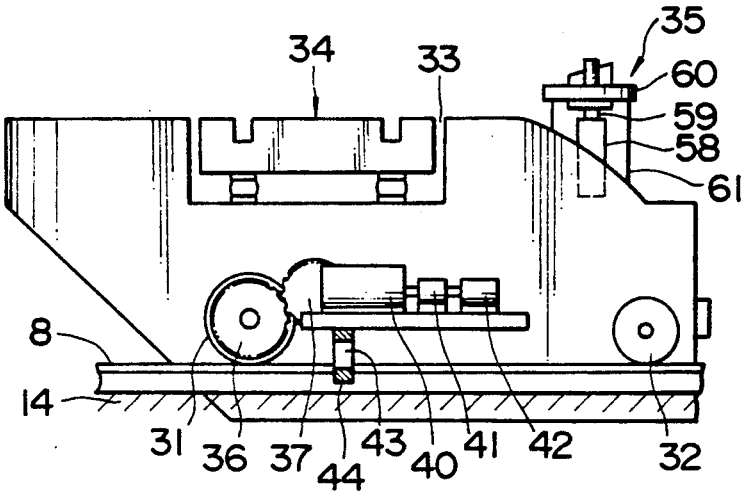

Referring now to FIGS. 3*a* and 3*b*, the travelling truck 5 is includes a body 30 of a substantially ship shape having a bottom 29 which is cut away at a portion thereof adjacent the mold 3 (front side portion), a pair of front wheels 31 and a pair of rear wheels 32 provided at lower portions of outer faces of the left and right side walls of the body 30, a tundish receiving apparatus 34 provided on upper recessed portions 33 of the left and right side walls of the body 30 for measuring a weight of a tundish 6, and a seal pipe lifting apparatus 35 provided at upper rather rearward portions of the left and right side walls of the body 30. Then, in order to cause the travelling truck 5 to travel by itself, each of the front wheels 31 used has a gear 36 thereon, and an idler gear 37 is held in meshing engagement with the gear 36 and also with a pinion 39 mounted on a table 38 which extends outwardly from one of the side walls of the travelling truck 5 while a driving apparatus constituted from a speed reducer 40, an electromagnetic brake 41 and a drive motor 42 all provided on the table 42 is connected to the pinion 49. A member 44 having an angular hole 43 perforated therein is provided on a lower face of the table 38 such that it arrests the travelling truck 5 at the tilting apparatus 7 when the travelling truck 5 rides over to the tilting apparatus 7 as hereinafter described in detail.

Figure 4A:
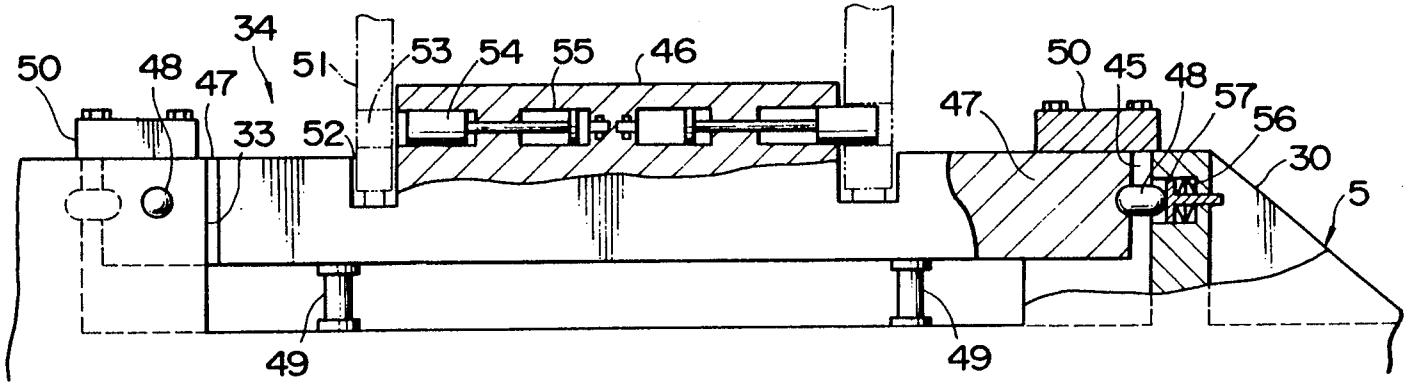
FIGS. 4*a* and 4*b* are a front elevational view and a top plan view, respectively, of a tundish receiving apparatus of the continuous casting equipment of FIG. 1.
Figure 4B:
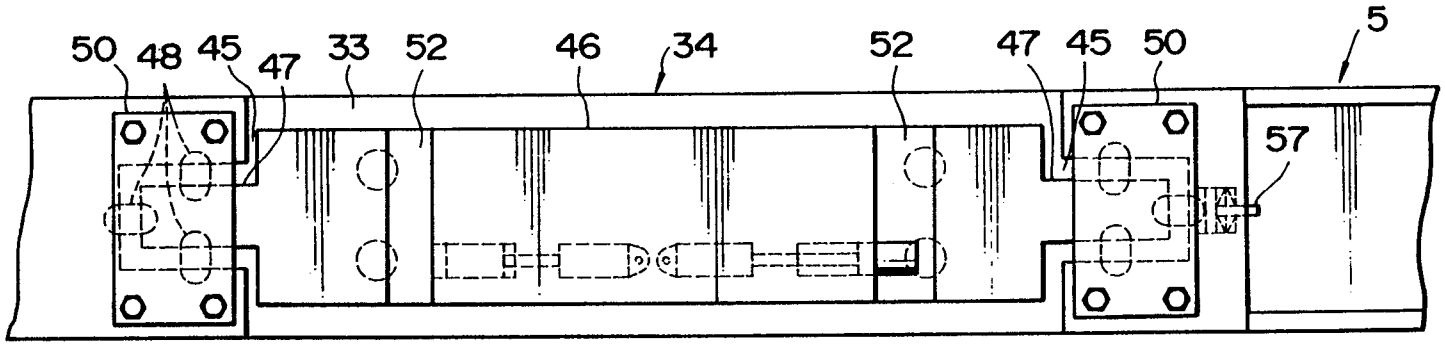

Referring now to FIGS. 4*a* and 4*b*, the tundish receiving apparatus 34 includes a weight measuring frame 46 having a pair of outer extensions 47 formed on the opposite front and rear end faces thereof. The extensions 47 of the weight measuring frame 46 are fitted in a pair of grooves 45 provided on front and rear wall faces of the upper recessed portion 33 with a plurality of check rods 48 interposed therebetween, and a plurality of load cells 49 are disposed between an upper face of the upper recessed portion 33 and a lower face of the weight measuring frame 46 while a pair of holding plates 50 for the extensions 47 of the weight measuring frame 46 are secured to upper faces of the grooves 45 by means of bolts to support the weight measuring frame 46 in a floating condition above the upper recessed portion 33. Meanwhile, a plurality of receiving grooves 52 for receiving trunnions 51 of a tundish 6 therein are provided in a predetermined spaced realtionship at forward and rearward locations on an upper face of the weight measuring frame 46, and a pair of rods 54 for engaging with arresting holes 53 of the trunnions 51 and a pair of power cylinders 55 for individually driving the rods 54 to move into or out of the arresting holes 53 are disposed in a wall between the front and rear grooves 52. Further, one of the check rods 48 which is provided at a rear end of the rear groove 45 is supported by a push rod 57 provided on a rear face of the upper recessed portion 33 and having a belleville spring 56 such that, when a tundish 6 is received on the tundish receiving apparatus 34 and tilted by the tilting apparatus 7, a rear end face of the weight measuring frame 46 and the opposing end face of the upper recessed portion 33 are contacted with each other to receive the load of the tundish 6.

Referring back to FIGS. 3*a* and 3*b*, the seal pipe lifting apparatus 35 includes a seal pipe supporting frame 60 provided at an end portion of a screw shaft 59 of an electrically operated screw jack 58 embedded in each of the left and right side walls of the body 30 such that the seal pipe supporting frame 60 is removably held between a flange and a cotter provided at an end portion of the shaft 59, and a seal pipe 61 is provided at a central portion of the frame 60.

Figure 5A:
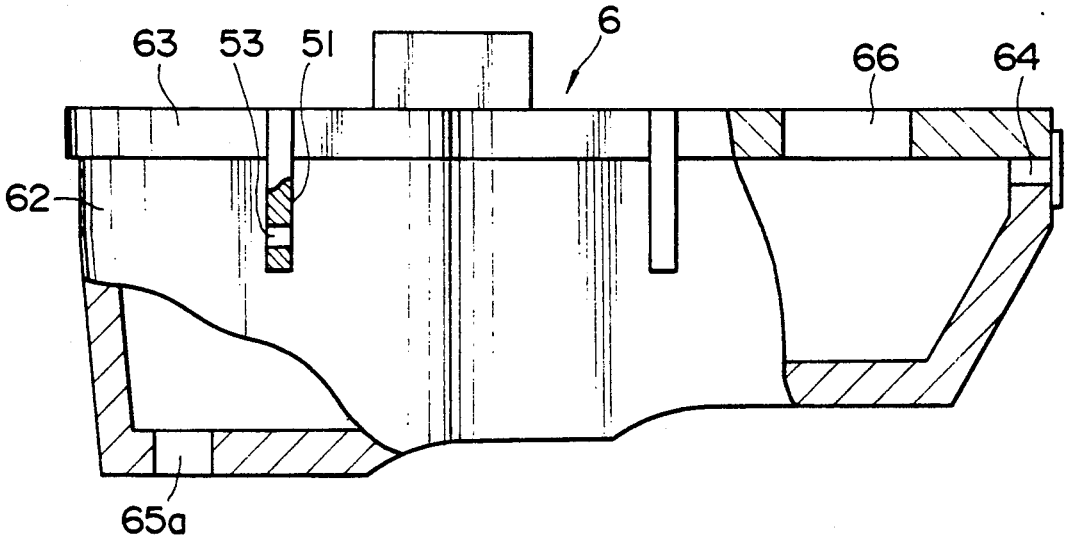
FIGS. 5*a* and 5*b* are a front elevational view and a top plan view, respectively, of a tundish of the continuous casting equipment of FIG. 1.
Figure 5B:
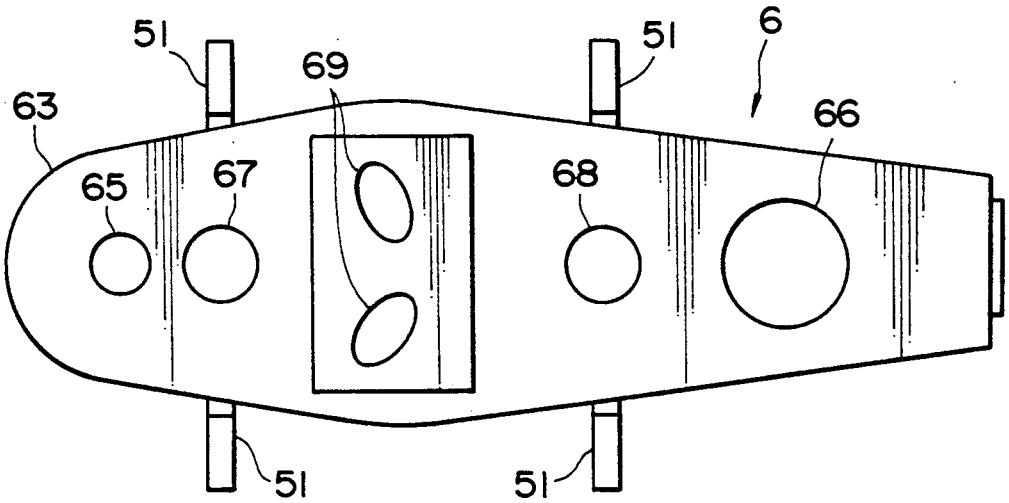

Referring now to FIGS. 5*a* and 5*b*, the tundish 6 includes a tundish body 62 and a tundish lid 63. The tundish lid 63 is removably secured to an upper end face of a side wall of the tundish body 62 in an airtight condition leaving a molten scum discharging opening 64 at a rear end thereof. Two pairs of suspending trunnions 51 each in the form of a plate are provided on the opposite left and right outer side faces of the tundish body 62, and such an arresting hole 53 as described hereinabove is formed at a lower portion of each of the trunnions 51 such that it is engaged with the corresponding rod 54 provided on the weight measuring frame 46 when the trunnion 51 is placed in the corresponding receiving groove 52 of the weight measuring frame 46 of the travelling truck 5. Further, a pouring gate 65*a* is provided at a forward portion of a bottom wall of the tundish body 62. Meanwhile, an opening 65 for the maintenance of the pouring gate 65*a* and so forth is provided at a location of the tundish lid 63 opposing to the pouring gate 65*a* while a receiving gate 66 for receiving molten metal from the ladle 2 is provided at a rear portion of the tundish lid 63, and a pair of opening 67 and 68 for receiving drying heating burners therein are provided forwardly and rearwardly between the openings 65 and 66 while another pair of openings 69 for plasma torches are provided at left and right locations of a central portion of the tundish lid 63. Though not shown, a lid is provided for and closes each of the openings 65, 67, 68 and 69 except when the corresponding opening is to be used.

Referring back again to FIGS. 2*a* and 2*b*, the tilting apparatus 7 includes a tiltable table 73 having an uprightly erected frame 70 at a rear end of an upper face thereof and having at left and right ends thereof a pair of uprightly erected frames 72 on which a tilting shaft 71 is securely mounted. The tilting apparatus 7 further includes a pair of bearings 75 for holding the tilting shaft 71 on the left and right frames 14 in a skimming groove 74 which is formed in a large size and in which the tiltable table 73 is provided, and a driving apparatus 76 for driving the tilting shaft 71 to tilt the tiltable table 73. A pair of rails 77 which make part of the travel rails 8 are provided on an upper face of the tiltable table 73, and a pair of arresting apparatus 78 are also provided on the upper face of the tiltable table 73 such that they are engaged with the angular holes 43 of the members 44 provided on the lower face of the base 38 of the travelling truck 5 to arrest the travelling truck 5 when the travelling truck 5 rides on a location between the rails 77 and the uprightly erected frame 72. Meanwhile, provided on the lower face of the tiltable table 73 are a pair of fixing members 81 for engaging with a pair of fixing apparatus 80 provided on a pair of left and right frame walls in the skimming groove 74 in order to hold, when the tiltable table 73 is tilted, such tilted condition, and a maintenance deck 79 for the maintenance of the lower face of a tundish 6 when the tiltable table 73 is tilted.

Figure 6A:
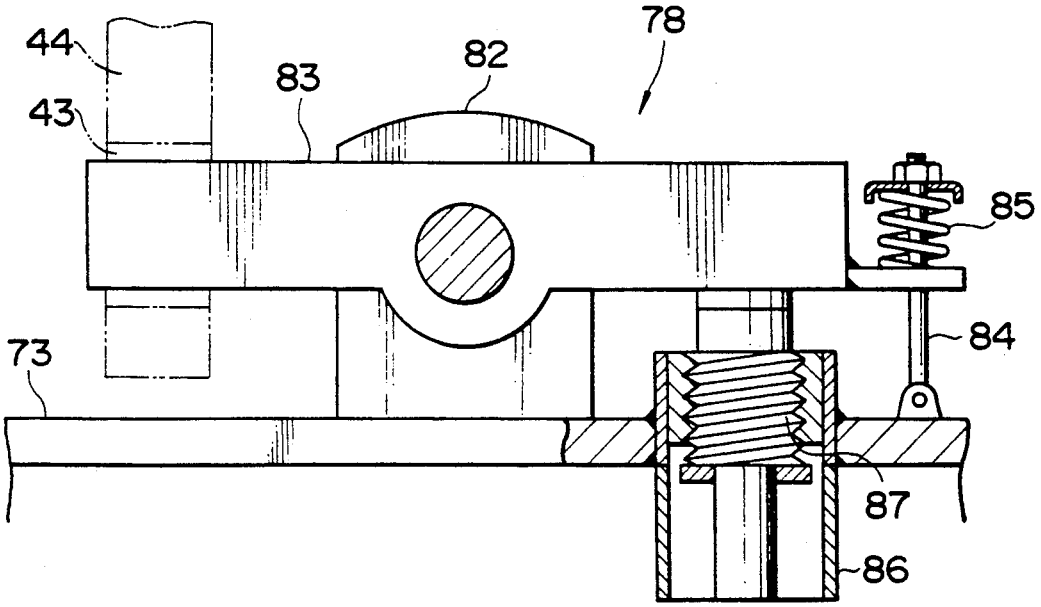
FIGS. 6*a* and 6*b* are a front elevational view and a top plan view, respectively, of an arresting apparatus for the travelling truck in the tilting apparatus of the continuous casting equipment of FIG. 1.
Figure 6B:
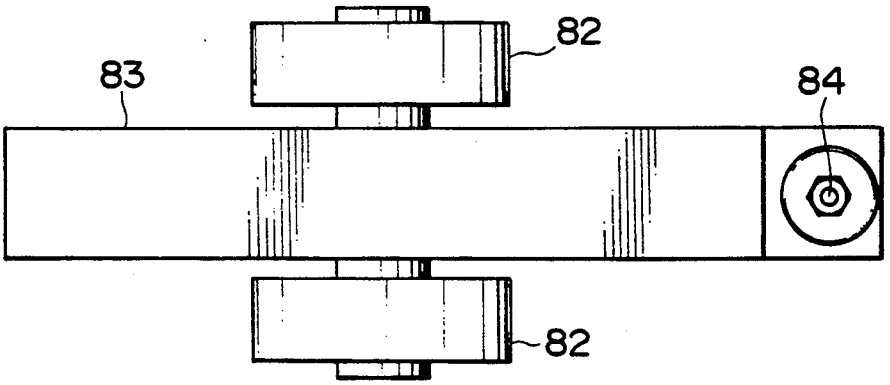

Referring now to FIGS. 6*a* and 6*b*, each of the arresting apparatus 78 includes an arm 83 supported for pivotal motion by means of a pair of bearings 82 provided on the tiltable table 73, and a rod 84 connected to the tiltable table 73 for acting upon a rear end portion of the arm 83. A spring 85 is provided such that a rear end of the arm 83 may normally be urged toward the upper face of the tiltable table 73, and a hydraulic rotary actuator 86 is disposed on the tiltable table 73 to act upon a lower end of a screw jack 87 so that an upper end of the screw jack 87 is normally held in contact with a lower face of a rear end portion of the arm 83. Thus, when the arms 83 are to be fitted into or removed from the angular holes 43 of the members 44 provided on the lower face of the base 38 of the travelling truck 5, the hydraulic rotary actuators 86 are driven to project the screw jacks 87 upwardly against the spring force of the springs 85 to press the end portions of the arms 83 against the lower faces of the angular holes 43 to retain the travelling truck 5 on the tiltable table 73.

Referring back again to FIGS. 2*a* and 2*b*, the travelling rails 8 are constituted from the rails 23 provided on the pivotal table 24 of the pivoting apparatus 4, the rails 77 provided on the tiltable table 73 of the tilting apparatus 7, and a pair of rails 89 provided on an intermediate frame 88 (making part of the platform 14) between the pivoting apparatus 4 and the tilting apparatus 7. When the rails 23 and 89 are put into a travelling condition, rods 91 of a pair of cylinders 90 provided horizontally on the opposite sides of the intermediate frame 88 are projected into a pair of receiving holes 92 formed in the pivotal table 24 to hold the pivotal table 24 horizontally and hold the rails 23 and 89 in a same horizontal plane. Further, when the rails 77 and 89 are put into a travelling condition similarly, rods 94 of a pair of cylinders 93 provided horizontally on the opposite sides of the intermediate frame 88 are projected into a pair of receiving holes 95 formed in the tiltable table 73 to hold the tiltable table 73 horizontally and hold the rails 77 and 89 in a same horizontal plane.

Figure 7A:
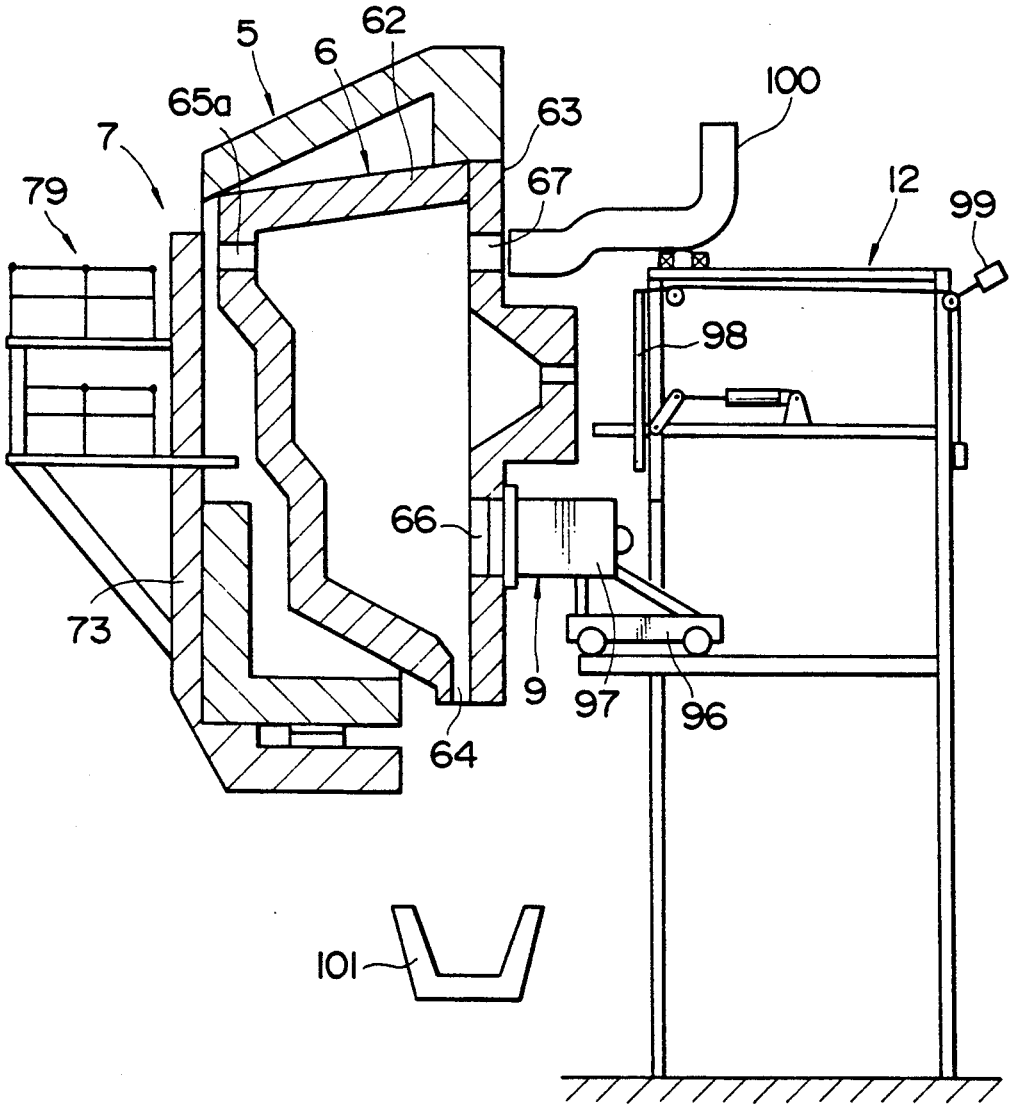
FIGS. 7*a* and 7*b* are a front elevational view, partly in section, and a side elevational view, respectively, showing a skimming section of the continuous casting equipment of FIG. 1.
Figure 7B:
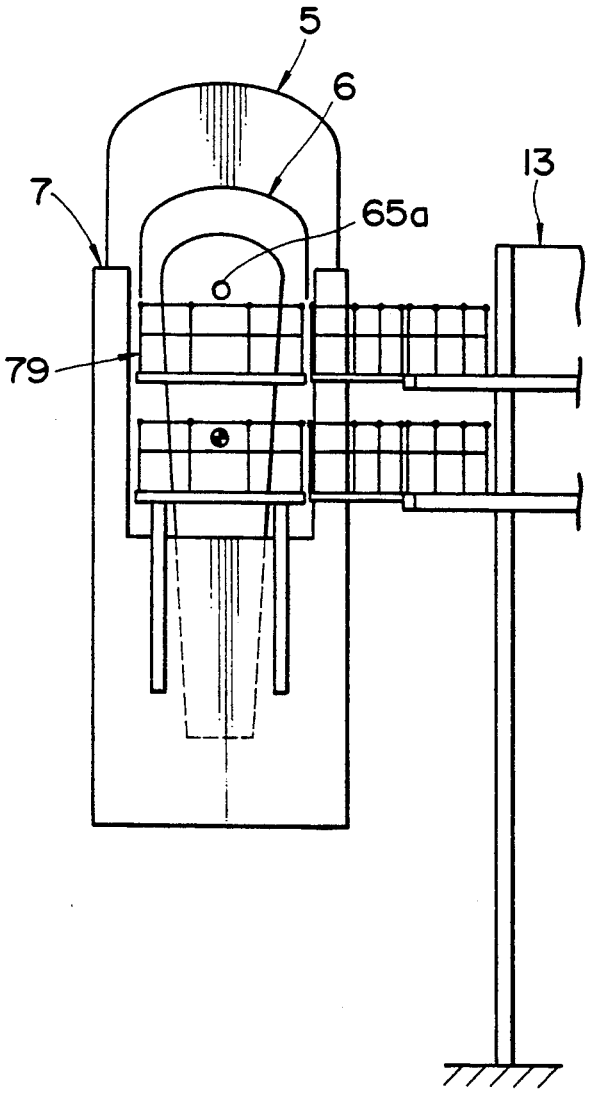

Referring now to FIGS. 7*a* and 7*b*, the heating burner apparatus 9 includes a self-travelling truck 96 and a heating burner 97 mounted on the truck 96. The heating burner apparatus 9 is mounted on the deck 12 erected uprightly at a location rearwardly of the skimming groove 74 such that, when the tiltable table 73 of the tilting apparatus 7 receives the travelling truck 5, on which a tundish 6 is placed, and is tilted, an end of the heating burner 97 may be positioned such that it is opposed to the receiving gate 66 of the tundish 6. It is to be noted that, in FIGS. 7*a* and 7*a*, reference numeral 98 denotes a protective gate, which is moved in upward and downward directions by a driving apparatus 99 so that, upon skimming, the heating burner apparatus 9 is protected from heat of ground metal and so forth being skimmed. Meanwhile, reference numeral 100 denotes an exhaust duct provided for turning motion on the deck 12, and the exhaust duct 100 is connected, when turned, to the opening 67. Meanwhile, reference numeral 101 denotes a skimmed scum vessel. Further, as the tiltable table 73 is tilted substantially vertically as shown in FIG. 7*a*, the maintenance deck 79 provided on the lower face of the tiltable table 73 is positioned horizontally. Thus, the other deck 13 located sidewardly of the tilting apparatus 7 is connected so that an operator can access to the maintenance deck 79 and perform maintenance of the lower face side of the tundish 6.

Figure 8A:
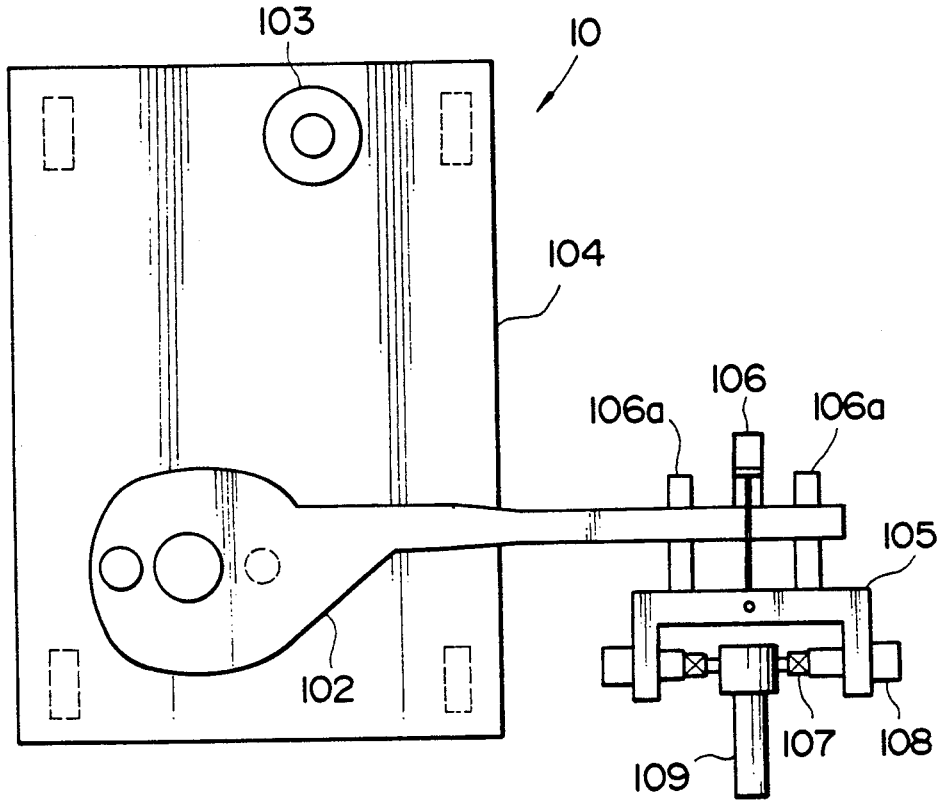
FIGS. 8*a* and 8*b* are a front elevational view and a side elevational view, respectively of a handling apparatus for a dipping nozzle of the continuous casting equipment of FIG. 1.
Figure 8B:
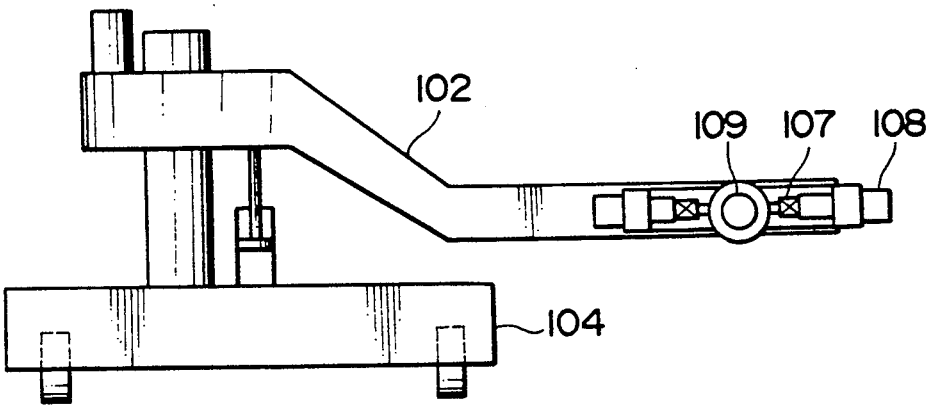

Referring now to FIGS. 8*a* and 8*b*, the handling apparatus 10 for a dipping nozzle is constituted such that a turnable and upwardly and downwardly movable arm 102 and a heating pot 103 are provided on a travelling truck 104. A channel-shaped frame 105 is supported horizontally at an end portion of the arm 102 by means of a pair of sliding guides 106*a* and is moved back and forth by a cylinder 106. Another pair of cylinders 108 are provided at a pair of parallel portions of the channel-shaped frame 105 and each has a tilting rotary actuator 107 provided on a cylinder rod thereof such that they may hold a dipping nozzle 109 therebetween. Then, the handling apparatus 10 normally waits at its standby position while heating the dipping nozzle 109 by means of the heating pot 103, but immediately before casting is started, the handling apparatus 10 travels by itself to its casting position. At the casting position, the channel-shaped frame 105 is turned to a position above the heating pot 103 in a condition wherein the arm 102 is lifted, and then the channel-shaped frame 105 is moved down to catch thereon the thus heated dipping nozzle 109 by means of the cylinders 108. Subsequently, the arm 102 is lifted, and while it is turned subsequently, the tilting rotary actuators 107 are driven to erect the dipping nozzle 109 vertically upwardly and insert the same into the mold 3. Thus, the dipping nozzle 109 is fixed the pouring gate 65*a* at the lower face of the tundish 6 positioned above the mold 3.

Figure 9A:
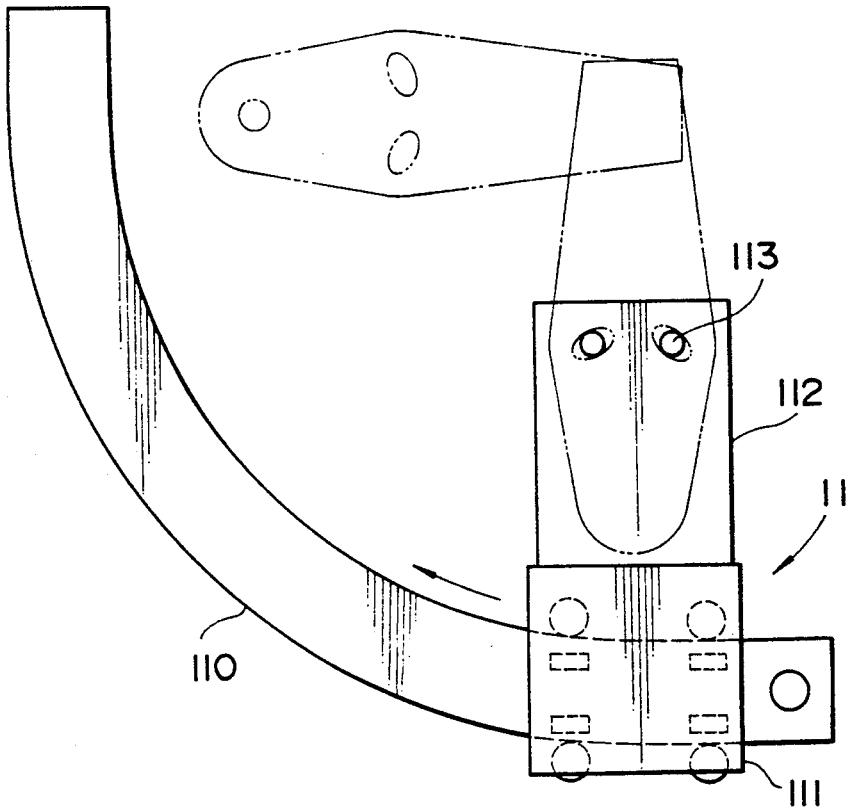
FIGS. 9*a* and 9*b* are a front elevational view and a side elevational view, respectively, of a plasma heating apparatus of the continuous casting equipment of FIG. 1.
Figure 9B:
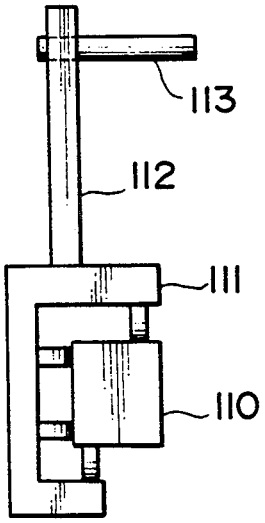
Figure 10A:
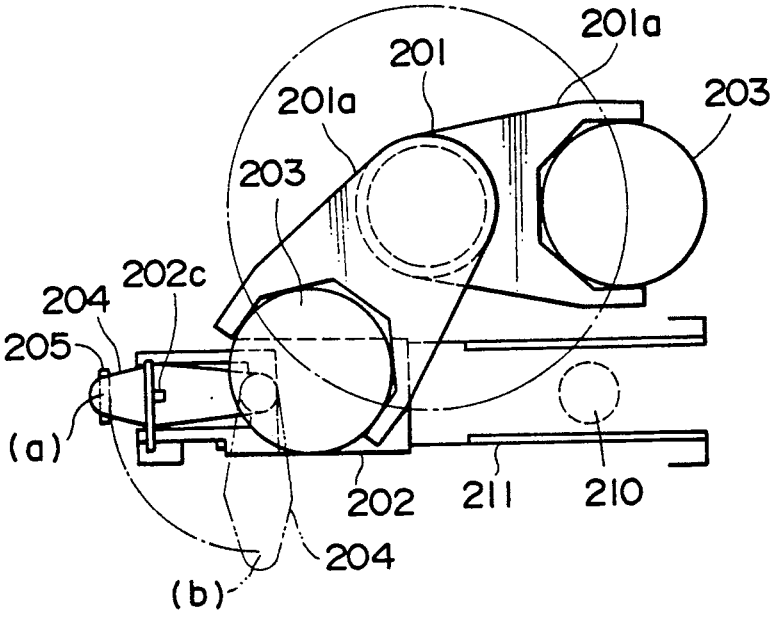
FIG. 10a PRIOR ART
FIG. 10*a* is a top plan view showing a general arrangement of a conventional continuous casting equipment.
Figure 10B:
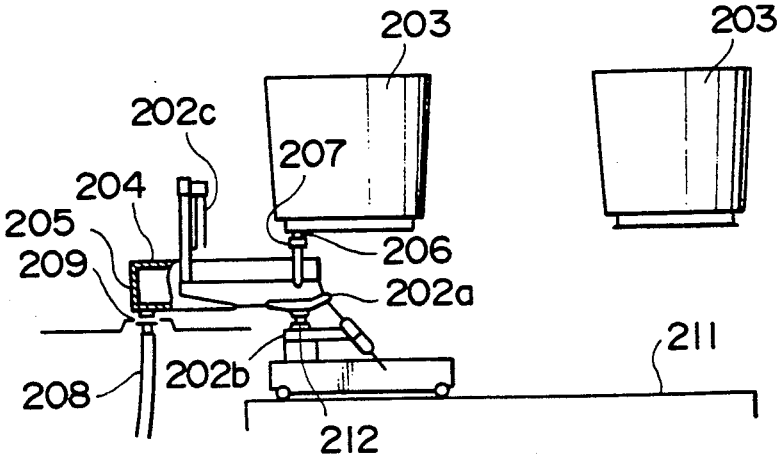
FIG. 10b PRIOR ART
FIG. 10*b* is a partial front elevational view of the continuous casting equipment of FIG. 10*a;*
Figure 10C:
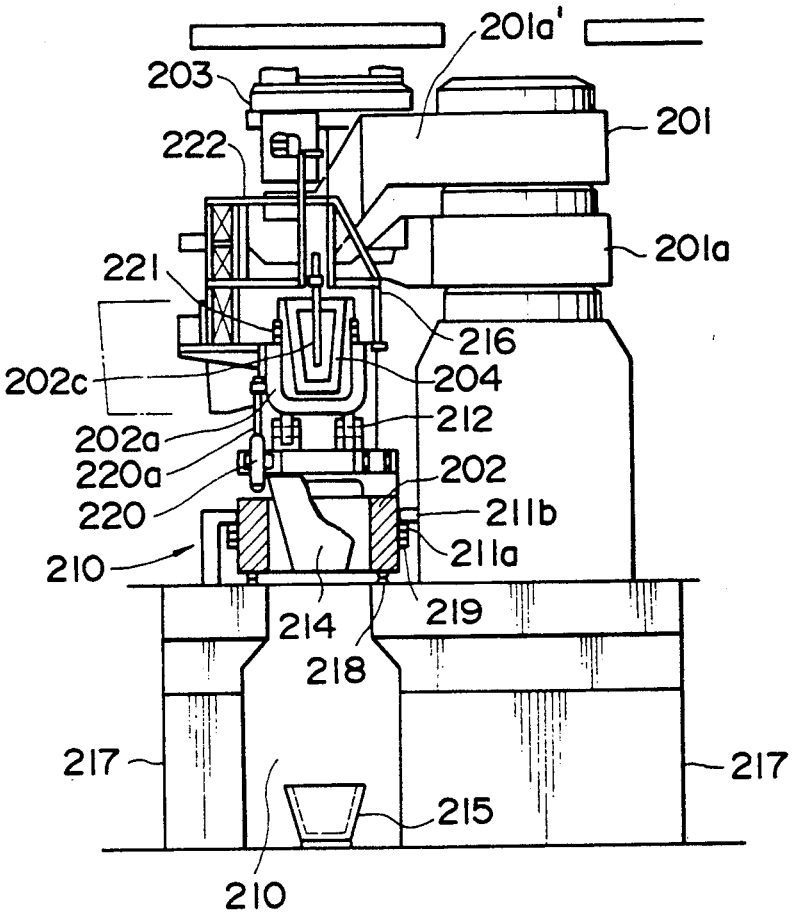
FIG. 10c PRIOR ART
FIG. 10*c* is a side elevational view of the continuous casting equipment of FIG. 10*a;*
Figure 10D:
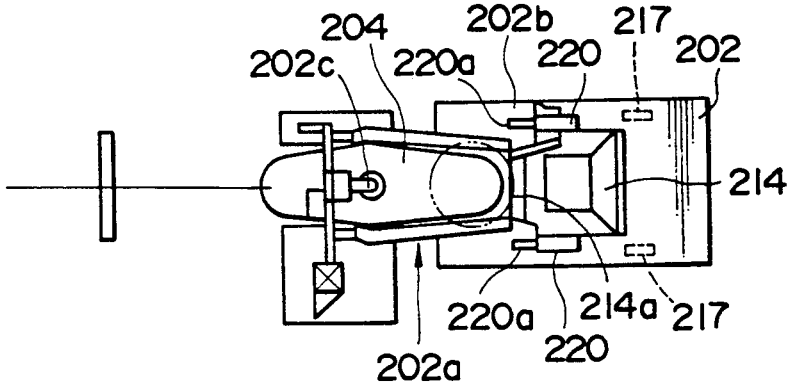
FIG. 10d PRIOR ART
FIG. 10*d* is a top plan view of a travelling truck of the continuous casting equipment of FIG. 10*a*.
Figure 10E:
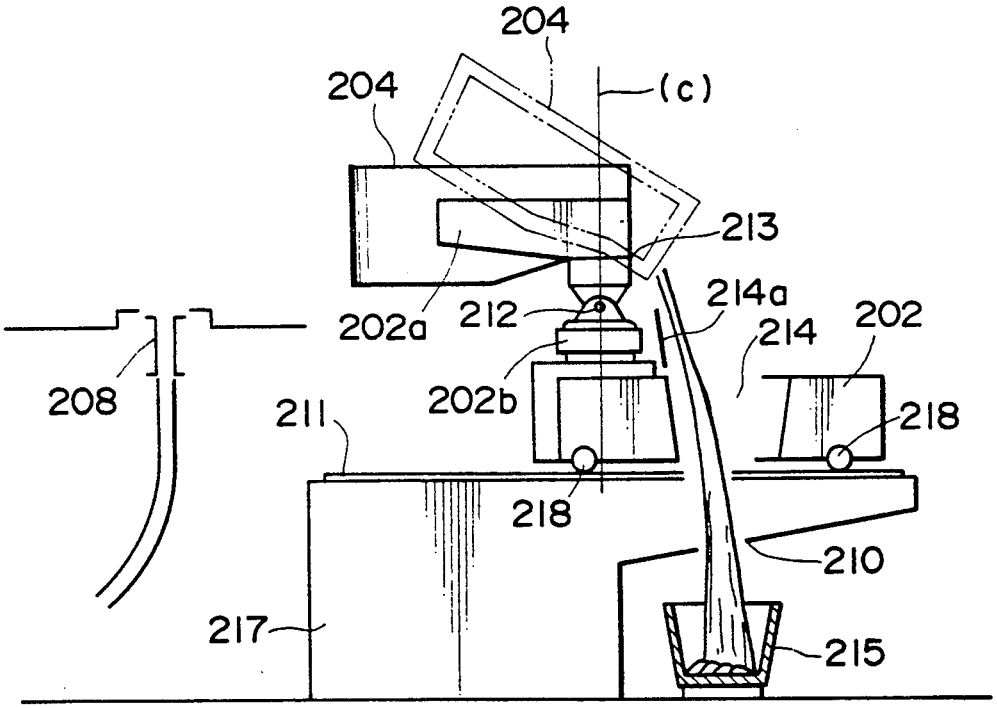
FIG. 10e PRIOR ART
FIG. 10*e* is a schematic front elevational view illustrating a skimming operation of a tundish of the continuous casting equipment of FIG. 10*a.*

Referring now to FIGS. 9*a* and 9*b*, the plasma heating apparatus 11 includes a self-travelling truck 111 mounted on an arcuate rail 110 centered at the center of pivotal motion of the pivotal table 24 and having thereon wheels for rolling on an upper face and the opposite side faces of the arcuate rail 110. An arm 112 is provided on the self-travelling truck 111 such that it is directed to the center of pivotal motion of the pivotal table 24, and a pair of plasma torches 113 are provided at an end portion of the arm 112. The plasma heating apparatus 11 is used to preheat the inside of the tundish 6 when the tundish 6 is at its standby position (b) after it has been placed onto the pivotal table 24 together with the travelling truck 5 and also to heat molten steel in the tundish 6 when the tundish 6 receives, at the receiving gate 66 thereof, molten metal from the ladle 2 and waits at its standby position (b) and also when the tundish 6 moves to its casting position (a) after then and further to maintain the heat of molten metal in the tundish 6 during casting or when it is necessary.

The continuous casting equipment having such construction as described above is used, for example, in the following manner upon continuous casting.

I) The tundish 6 preheated at a tundish preheating location not shown is hung by means of a crane not shown and is placed onto the tundish receiving apparatus 34 of the travelling truck 5 on the travel rails 8, and then the rods 54 of the receiving apparatus 34 are inserted into the arresting holes 53 of the trunnions 51 of the tundish 6 to fix the tundish 6 to the travelling truck 5. After then, the seal pipe supporting frame 60 is fixed above the receiving gate 66 of the tundish 6 by the upper end of the screw shaft 59 of the seal pipe lifting apparatus 35.

II) The travelling truck 5 is caused to travel on the travel rails 8 to ride onto the tiltable table 73 of the tilting apparatus 7 held horizontally in a travelling condition until a rear end thereof is contacted with the uprightly erected frame 70, and the angular holes 43 of the members 44 provided on the lower face of the table 38 of the travelling truck 5 are engaged with the arms 83 of the arresting apparatus 78 to fix the travelling truck 5. Then, the driving apparatus 76 are driven to tilt the tiltable table 83 vertically around the axis of the tilting shafts 71, and after such tilting movement is completed, since the temperature is dropped while the tundish 6 is placed onto the travelling truck 5, in order to compensate for such temperature drop, the protective gate 98 of the heating burner apparatus 9 provided on the deck 12 is opened and the heating burner 97 is advanced until the end thereof is opposed to the receiving gate 66 of the tundish 6 while the exhaust duct 100 also provided on the deck 12 is turned so that it is connected to the opening 67 of the tundish 6. Consequently, the inside of the tundish 6 is heated by the heating burner 97. In this instance, necessary maintenance for the upper face, bottom face and so forth of the tundish 6 can be performed from above the deck 12 and from the maintenance deck 79 which is provided on the lower face of the tiltable table 73 connected to the other deck 13. After the inside of the tundish 6 is heated to a predetermined temperature and preparations for casting are completed, the heating burner 97 and the exhaust duct 100 are removed from the tundish 6 and the heating burner apparatus 9 is accommodated into the deck 12 to its original condition, and the tiltable table 73 is tilted back to its horizontal position and fixation of the travelling truck 5 by the arms 83 of the arresting apparatus 78 is cancelled.

III) The travelling truck 5 is caused to travel by itself from the tiltable table 73 of the tilting apparatus 7 onto the travel rails 8 until it rides over to the pivotal table 24 of the pivoting apparatus 4 held at its travelling position (d), and when the center of the receiving gate 66 of the tundish 6 is positioned at the center of pivotal motion of the pivotal table 24, the driving motor 19 for the self travelling is stopped and the electromagnetic brake 21 is rendered operative to fix the travelling truck 5.

IV) After then, the pivotal table 24 is pivoted to its standby position (b) and then fixed to the position. When the pivotal table 24 is at the standby position (b), maintenance of the mold 3 and insertion of a dummy bar (not shown) are performed, and further, when it is necessary, maintenance and repair of the pouring gate 65*a* of the bottom portion of the tundish 6 and so forth and a casting preparing operation such as heating of the inside of the tundish 6 are performed. At the same time, a ladle 2 filled with molten metal is loaded onto one of the arms 15 of the ladle exchanging apparatus 1, and then, the ladle 2 is turned by way of the arm 15 to a position above the tundish 6 for which the preparing operation has completed thereby to set the skimming nozzle between the tundish 6 and the skimming valve opening of the ladle 2. Then, the seal pipe 61 is lifted by the seal pipe lifting apparatus 35 to seal the skimming valve opening, and the valve of the skimming valve opening is opened to allow molten metal in the ladle 2 to be poured into the tundish 6. Then, after a predetermined amount of molten metal is accumulated in the tundish 6, the plasma torches 113 of the plasma heating apparatus 11 are set in position to heat the molten metal.

V) After then, the tundish 6 is pivoted from its standby position (b) to its casting position (a) while receiving molten metal at a minimum flow rate from the ladle 2 and while continuing heating of the molten metal by the plasma heating apparatus 11, and when it is pivoted to the casting position (a), the dipping nozzle 109 heated by the heating pot 103 of the dipping nozzle handling apparatus 10 is set between the pouring valve opening of the tundish 6 and the mold 3 by the handling apparatus 10 and is then sealed. After then, the valve of the pouring valve opening of the tundish 6 is opened to start continuous casting. During such casting, upon continuous continuous casting, when casting of all of the molten metal in the ladle 2 is completed, the skimming nozzle thereof is removed and the empty ladle 2 is turned to its retracted position, and then another ladle 2 filled with molten metal and loaded already on the other empty arm 15 is turned so that it is connected at the skimming nozzle thereof to the tundish 6 to allow the molten metal to be skimmed into the tundish 6. Consequently, casting can be continued after then.

Upon completion of casting, the valve of the skimming valve opening of the ladle 2 is closed, and a remaining amount of molten metal in the tundish 6 is monitored by way of the weight measuring frame 46 and load cell 49 of the tundish receiving apparatus 34 of the travelling truck 5. Thus, upon completion of casting, the valve of the pouring valve opening is closed, thereby completing the casting operation.

VI) After completion of such casting operation, the ladle 2 is turned to move away from the position above the tundish 6, and the pivotal table 24 of the pivoting apparatus 4 is pivoted from its casting position (a) to its travelling position (d). Then, the travelling truck 5 is caused to travel by itself from the pivotal table 24 of the pivoting apparatus 4 onto the travel rails 8 so that it rides over in a similar condition as described in II) hereinabove onto the tiltable table 73 of the tilting apparatus 7 held horizontally in a travelling condition, and the travelling truck 5 is tilted similarly to skim ground metal, scum and so forth remaining in the tundish 6 into the skimmed scum vessel 101. Then, when it is necessary, the inside of the tundish 6 is heated by the heating burner apparatus 9 to heat the ground metal, scum and so forth in a solidified condition into a melted condition so that it can be skimmed. After such skimming is completed, the heating burner apparatus 9 is accommodated back to its original condition, and the tiltable table 73 is returned to its horizontal condition. Then, fixation of the travelling truck 5 by the arms 83 of the arresting apparatus 78 is cancelled. Thus, the operations of III) to VI) described above can be performed repetitively.

VII) When the tundish 6 is to be exchanged, an operation reverse to that of I) described hereinabove is performed and the tundish 6 is carried out from the travelling truck 5 by the crane.

In this manner, according to the present invention, since the ladle exchanging apparatus 1 on which the molten metal ladle 2 is removably supported for turning movement is disposed sidewardly of the travel rails 8 for the travelling truck 5 and the pivoting apparatus 4 on which part of the rails 8 are provided is disposed sidewardly of the continuous casting mold 3 while the tilting apparatus 7 on which part of the rail 8*s* are provided is disposed at the skimming section, only because the molten metal pouring tundish 6 is removably provided on the travelling truck 5, pivoting motion of the tundish 6 to its casting position (a) or the like on the travelling truck 5 can be performed with stability and also rocking motion upon skimming can be performed with safety.

Having now fully described the invention, it will be apparent to one of ordinary skill in the art that many changes and modifications can be made thereto without departing from the spirit and scope of the invention as set forth herein.

What is claimed is:

1. A continuous casting apparatus, comprising:

a tundish for receiving molten metal poured from a ladle and for pouring the molten metal into a continuous casting mold:

a travelling truck for carrying said tundish between a casting section at which said continuous casting mold is located and a skimming section at which molten scum in said tundish is to be discharged; and a tilting apparatus located at said skimming section for tilting said tundish together with said travelling truck on which said tundish is carried to allow molten scum to be discharged from within said tundish.

2. A continuous casting apparatus according to claim 1, further comprising arresting means for arresting said travelling truck on said tilting apparatus when said travelling truck is tilted by said tilting apparatus.

3. A continuous casting apparatus according to claim 1, wherein when said tundish is tilted by said tilting apparatus, a molten scum discharging opening of said tundish is positioned at a lower portion of said tundish.

4. A continuous casting apparatus according to claim 1, wherein said travelling truck travels on a travel rail extending between said casting section and said skimming section.

5. A continuous casting apparatus according to claim 4, wherein said tilting apparatus includes a tiltable table for receiving said travelling truck thereon, said tiltable table having part of said travel rail provided on an upper face thereof, and a tilting mechanism for tilting said tiltable table.

6. A continuous casting apparatus according to claim 5, wherein said tilting mechanism tilts said tiltable table around an axis extending perpendicularly to said travel rail.

7. A continuous casting apparatus according to claim 6, further comprising arresting means for arresting said travelling truck on said tilting apparatus when said travelling truck is tilted by said tilting apparatus, said arresting means including a pair of arresting apparatus provided on the opposite sides of said travel rail for engaging with said travelling truck and an uprightly erected frame erected uprightly at a rear end portion of said tiltable table.

8. A continuous casting apparatus according to claim 3, wherein said tundish includes a tundish body and a tundish lid, said tundish lid having at least one opening formed therein for receiving a heating burner therein, said tundish lid further having a molten metal receiving gate into which molten metal is to be poured from said ladle.

9. A continuous casting apparatus according to claim 8, further comprising a deck for the maintenance operation of said tundish disposed at a location opposite to an upper face of said tundish lid in a condition wherein said tundish is tilted by said tilting apparatus together with said travelling truck on which said tundish is carried, said deck having a heating burner apparatus adapted to be inserted into said molten metal receiving gate of said tundish lid.

10. A continuous casting apparatus according to claim 9, further comprising an exhaust duct provided on said deck and capable of being connected to said opening of said tundish lid.

11. A continuous casting apparatus according to claim 1, further comprising a pivoting apparatus provided at said casting section for pivoting said tundish around a vertical axis together with said travelling truck on which said tundish is carried.

12. A continuous casting apparatus according to claim 11, wherein said pivoting apparatus includes a pivotal table having part of said travel rail provided on an upper face thereof for receiving said travelling truck thereon, and a pivoting mechanism for pivoting said pivotal table around a vertical axis.

13. A continuous casting apparatus according to claim 11, further comprising a plasma heating apparatus for heating molten steel in said tundish, said plasma heating apparatus being mounted for travelling movement on an arcuate rail centered at the center of pivotal motion of said pivoting apparatus.

14. A continuous casting apparatus according to claim 1, wherein said travelling truck includes a body, moving means for moving said body, and a tundish receiving apparatus disposed at an upper portion of said body for receiving said tundish thereon.

15. A continuous casting apparatus according to claim 14, wherein said body has a tapered profile having a bottom which is cut away at a front portion thereof.

16. A continuous casting apparatus according to claim 14, wherein said tundish receiving apparatus has arresting means provided at an upper portion thereof for arresting, when said tundish is tilted together with said travelling truck.

17. A continuous casting apparatus according to claim 14, further comprising a load cell interposed between a lower face of said tundish receiving apparatus and an upper face of said body for measuring a weight of said tundish and molten steel in said tundish.

18. A continuous casting apparatus according to claim 17, wherein said tundish receiving apparatus has a plurality of projections formed on side faces thereof, and further comprising a plurality of check rods provided on said body in a contacting condition with said projections of said tundish receiving apparatus to hold said tundish receiving apparatus in a suspended condition on said body.

19. A continuous casting apparatus according to claim 18, wherein one of said check rods which is positioned at a lower position when said tundish is tilted together with said travelling truck.

20. A continuous casting apparatus according to claim 11, further comprising a semicircular trough centered at the center of pivotal motion of said pivoting apparatus and provided on said pivoting apparatus adjacent said tilting apparatus, a travelling device mounted for movement around an inner wall of said trough, an arresting apparatus for arresting said travelling device on said pivoting apparatus, a first cable disposed in a folded condition in said trough and connected at an end thereof to a cable entrance formed in an outer wall of said trough and at the other end thereof to said travelling device, and a second cable interconnecting said travelling truck and said travelling device.

21. A continuous casing apparatus according to claim 20, wherein said arresting apparatus is capable of removably arresting said travelling device on said pivoting apparatus, and further comprising a second arresting apparatus for arresting said travelling device on said trough.

22. A continuous casting method, comprising the steps of moving, after completion of a preceding casting operation, a travelling truck on which a tundish is carried from a casting section at which a continuous casting mold is located to a skimming section at which molten scum in said tundish is to be discharged, tilting, at said skimming section, said tundish together with said travelling truck on which said tundish is carried to allow molten scum to be discharged from within said tundish, returning said travelling truck to its horizontal position, moving said travelling truck on which said tundish is carried from said skimming section at which molten scum in said tundish is to be discharged to said casting section at which said continuous casting mold is located, and performing a next casting operation.

23. A continuous casting method according to claim 22, wherein, at the tilting step, the inside of said tundish is heated by a heating burner apparatus to heat molten scum in said tundish into a melted condition while said tundish is kept in a tilted condition at said skimming section together with said travelling truck on which said tundish is carried.

24. A continuous casting method according to claim 22, wherein, at the tilting step, maintenance of a lower face of said tundish is performed in a condition wherein said tundish is tilted at said skimming section together with said travelling truck on which said tundish is carried.

* * * * *